US008652718B2

(12) United States Patent
Tian et al.

(10) Patent No.: US 8,652,718 B2
(45) Date of Patent: Feb. 18, 2014

(54) RESIN COMPOSITION, IMAGE-FORMING MATERIAL, AND IMAGE-FORMING METHOD

(75) Inventors: Minquan Tian, Kanagawa (JP); Takahiro Ishizuka, Kanagawa (JP); Shinji Hasegawa, Kanagawa (JP); Makoto Furuki, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 20 days.

(21) Appl. No.: 13/566,611

(22) Filed: Aug. 3, 2012

(65) Prior Publication Data

US 2013/0189611 A1 Jul. 25, 2013

(30) Foreign Application Priority Data

Jan. 20, 2012 (JP) ..... 2012-010406

(51) Int. Cl.
*G03G 9/16* (2006.01)

(52) U.S. Cl.
USPC ..... 430/105; 430/108.1

(58) Field of Classification Search
USPC ..... 430/105, 108.1
See application file for complete search history.

(56) References Cited

U.S. PATENT DOCUMENTS

2002/0110767 A1 8/2002 Tanaka et al.
2006/0078834 A1* 4/2006 Fukusaka et al. ..... 430/619

FOREIGN PATENT DOCUMENTS

JP A-61-167680 7/1986
JP A-61-167681 7/1986
JP A-2001-011070 1/2001
JP A-2001-117201 4/2001
JP B2-4032160 1/2008

* cited by examiner

*Primary Examiner* — Hoa V Le
(74) *Attorney, Agent, or Firm* — Oliff PLC

(57) ABSTRACT

Provided is a resin composition containing a pyrylium-based squarylium compound represented by the following Formula (I) and a resin, Formula (I)

wherein in Formula (I), each of $R^1$, $R^2$, $R^3$, and $R^4$ independently represents an alkyl group having 2 to 5 carbon atoms.

11 Claims, 2 Drawing Sheets

RESIN COMPOSITION, IMAGE-FORMING MATERIAL, AND IMAGE-FORMING METHOD

CROSS-REFERENCE TO RELATED APPLICATIONS

This application is based on and claims priority under 35 USC 119 from Japanese Patent Application No. 2012-010406 filed Jan. 20, 2012.

BACKGROUND

1. Technical Field

The present invention relates to a resin composition, an image-forming material, and an image-forming method.

2. Related Art

In recent years, various compounds have become known as near infrared-absorbing materials, and methods of preparing the compound and compositions containing the compound have also become known.

SUMMARY

According to an aspect of the invention, there is provided a resin composition containing a pyrylium-based squarylium compound represented by the following Formula (I); and a resin.

Formula (I)

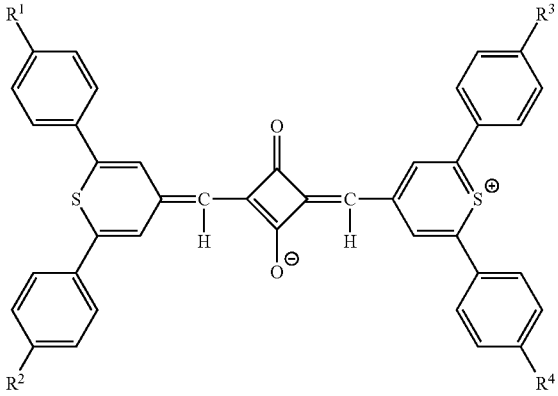

In Formula (I), each of $R^1$, $R^2$, $R^3$, and $R^4$ independently represents an alkyl group having from 2 to 5 carbon atoms.

BRIEF DESCRIPTION OF THE DRAWINGS

Exemplary embodiments of the present invention will be described in detail based on the following figures, wherein.

DETAILED DESCRIPTION

Figure 1:
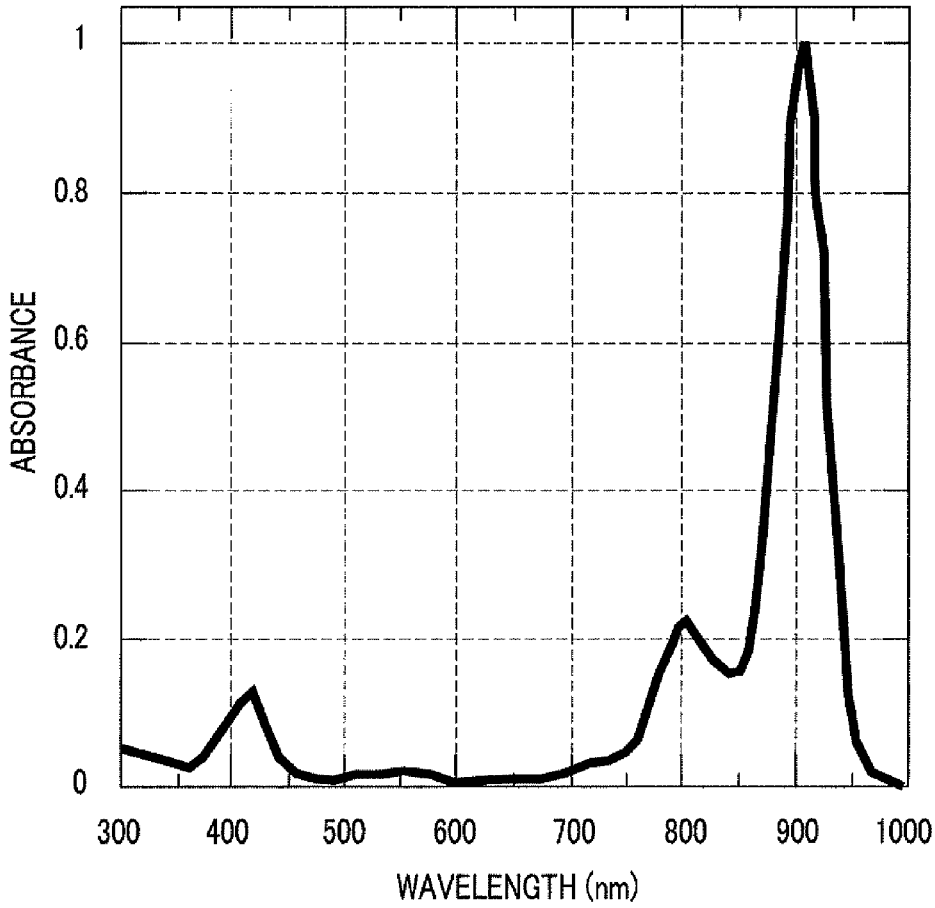
FIG. 1 is a visible near-infrared absorption spectrum of a compound represented by Formula (I-1)

Hereinbelow, exemplary embodiments of the resin composition, the image-forming material, and the image-forming method of the present invention will be described in detail.

Resin Composition and Image-Forming Material

The resin composition according to the present exemplary embodiment contains a compound represented by Formula (I) and a resin. The resin composition according to the present exemplary embodiment may contain other components according to purposes.

The resin composition according to the present exemplary embodiment exhibits superior dispersibility of a pyrylium-based squarylium compound which is a near infrared-absorbing material, compared to a resin composition that contains a pyrylium-based squarylium compound other than the compound represented by Formula (I). Accordingly, even if the resin composition according to the present exemplary embodiment contains a smaller amount of the pyrylium-based squarylium compound as a near infrared-absorbing material, compared to the resin composition that contains a pyrylium-based squarylium compound other than the compound represented by Formula (I), the resin composition according to the present exemplary embodiment efficiently absorbs near infrared light (for example, light having a wavelength of from 760 nm to 970 nm).

Pyrylium-Based Squarylium Compound

The pyrylium-based squarylium compound contained in the resin composition according to the present exemplary embodiment is a compound represented by the following Formula (I).

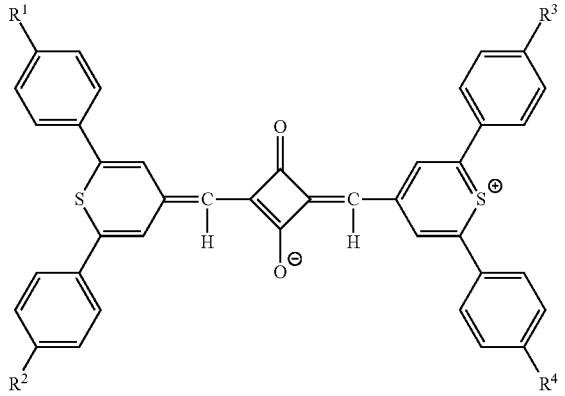

In Formula (I), each of $R^1$, $R^2$, $R^3$, and $R^4$ independently represents an alkyl group having from 2 to 5 carbon atoms.

The maximum absorption wavelength of the compound represented by Formula (I) in a tetrahydrofuran solution is 908 nm, and this compound excellently absorbs light having a wavelength of from 760 nm to 970 nm. Consequently, the compound represented by Formula (I) is useful as a near infrared-absorbing material.

Moreover, the dispersibility of the compound represented by Formula (I) in a resin is superior to a pyrylium-based squarylium compound other than the compound represented by Formula (I). Accordingly, the compound represented by Formula (I) is useful as a near infrared-absorbing material contained in a resin composition.

The compound represented by Formula (I) dissolves excellently in solvents, for example, tetrahydrofuran, chloroform, and the like. Therefore, it is considered that the compound represented by Formula (I) exhibits excellent affinity with a resin that dissolves excellently in solvents such as tetrahydrofuran and chloroform, and that the compound exhibits excellent dispersibility in this resin.

Specifically, examples of the resin which dissolves excellently in tetrahydrofuran include a polyester resin, an epoxy resin, a styrene-acryl resin, a polyamide resin, a polyvinyl resin, a polyolefin resin, a poly(alkyl methacrylate) resin, a polystyrene resin, an acrylic resin, a polyurethane resin, a polybutadiene resin, and the like.

The pyrylium-based squarylium compound in which at least one of $R^1$, $R^2$, $R^3$, and $R^4$ in Formula (I) is a methyl group or a hydrogen atom exhibits poorer dispersibility in a resin, compared to the compound represented by Formula (I). Accordingly, the resin composition containing the pyrylium-based squarylium compound is inferior in the absorption efficiency of light having a wavelength of from 760 nm to 970 nm, compared to the resin composition according to the present exemplary embodiment.

On the other hand, a pyrylium-based squarylium compound in which at least one of $R^1$, $R^2$, $R^3$, and $R^4$ in Formula (I) is an alkyl group having 6 or more carbon atoms tends to exhibit a decreasing gram extinction coefficient. Accordingly, the resin composition containing the pyrylium-based squarylium compound is inferior in the absorption efficiency of light having a wavelength of from 760 nm to 970 nm, compared to the resin composition according to the present exemplary embodiment, when the weight concentration of the pyrylium-based squarylium compounds is the same.

Examples of the alkyl group having from 2 to 5 carbon atoms and represented by $R^1$, $R^2$, $R^3$, and $R^4$ in Formula (I) include an ethyl group, an n-propyl group, an isopropyl group, an n-butyl group, an isobutyl group, a sec-butyl group, a tert-butyl group, a pentyl group, an isopentyl group, a neopentyl group, a tert-pentyl group, and the like.

In the alkyl group represented by $R^1$, $R^2$, $R^3$, and $R^4$, $R^1$ is preferably the same as $R^3$, $R^2$ is preferably the same as $R^4$, and all of $R^1$, $R^2$, $R^3$, and $R^4$ are more preferably the same as each other, from the viewpoint of easiness of synthesis and molecular stability of the compound represented by Formula (I).

Regarding the alkyl group represented by $R^1$, $R^2$, $R^3$, and $R^4$, all of $R^1$, $R^2$, $R^3$, and $R^4$ are preferably the same alkyl group having 2 to 4 carbon atoms, and all of $R^1$, $R^2$, $R^3$, and $R^4$ are more preferably the same alkyl group (any one of an n-butyl group, an isobutyl group, a sec-butyl group, and a tert-butyl group) having 4 carbon atoms, from the viewpoints of excellent dispersibility of the compound represented by Formula (I) in a resin and easiness of synthesis and molecular stability of the compound represented by Formula (I).

Examples of the compound represented by Formula (I) include compounds represented by the following Formulae (I-1) to (I-12).

Formula (I-1)

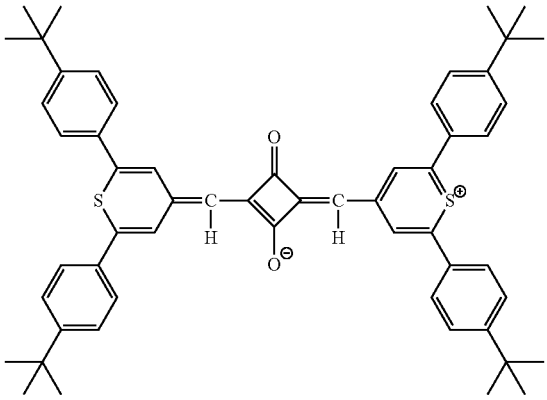

-continued

Formula (I-2)

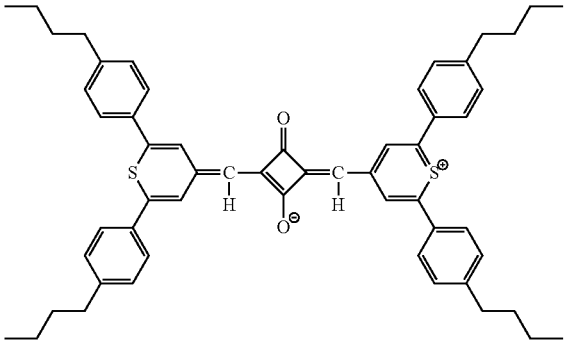

Formula (I-3)

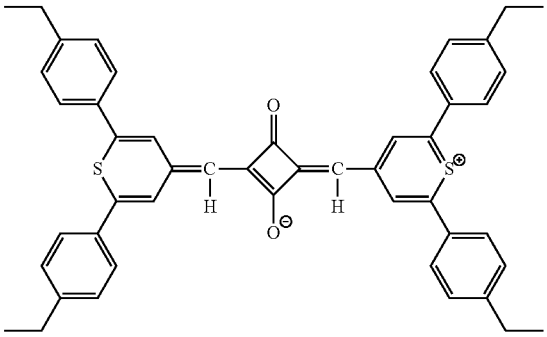

Formula (I-4)

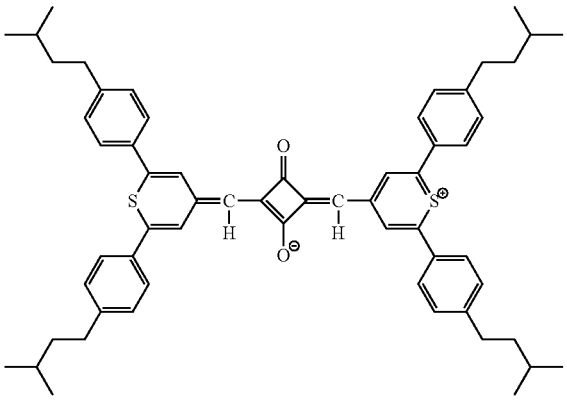

Formula (I-5)

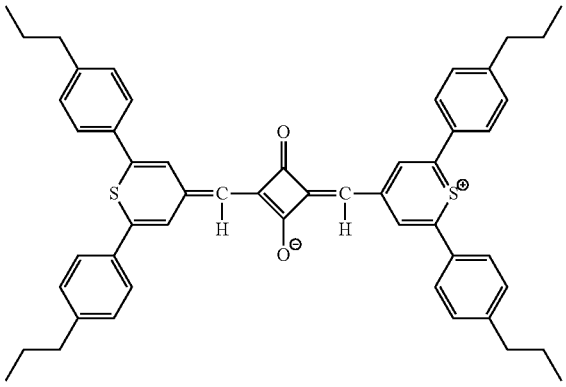

-continued

Formula (I-6)

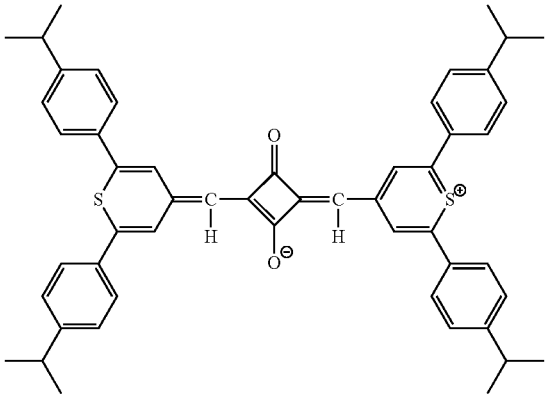

Formula (I-7)

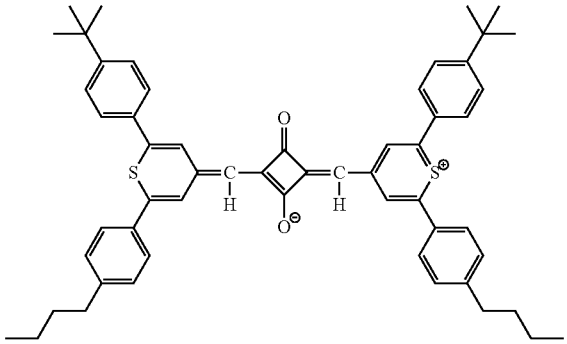

Formula (I-8)

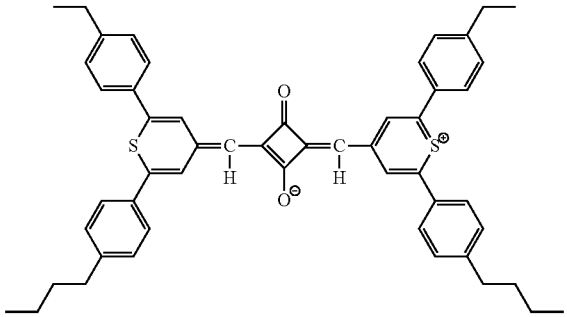

(Formula (I-9)

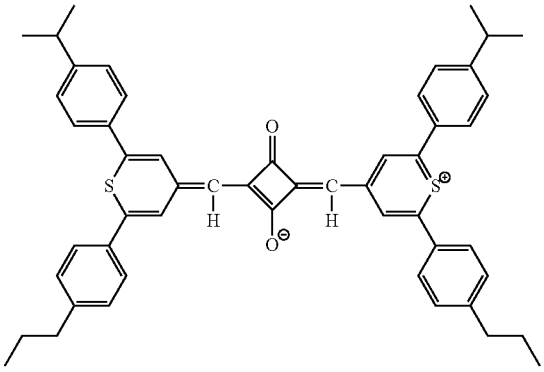

-continued

Formula (I-10)

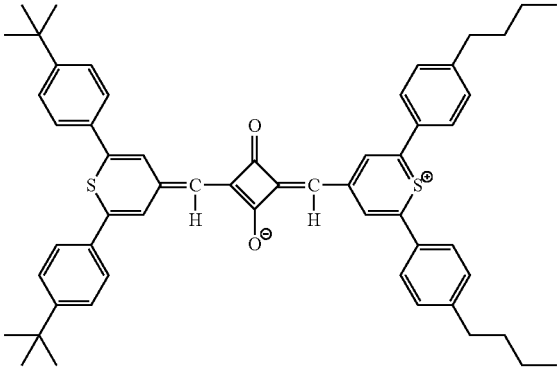

Formula (I-11)

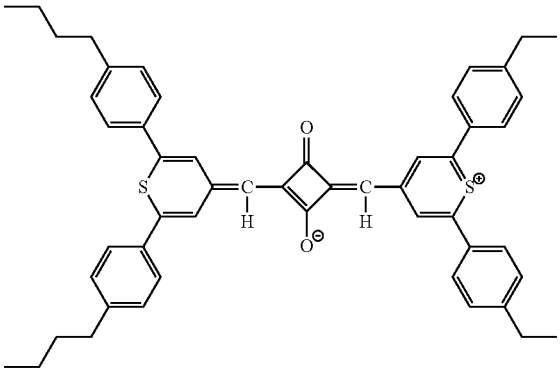

Formula (I-12)

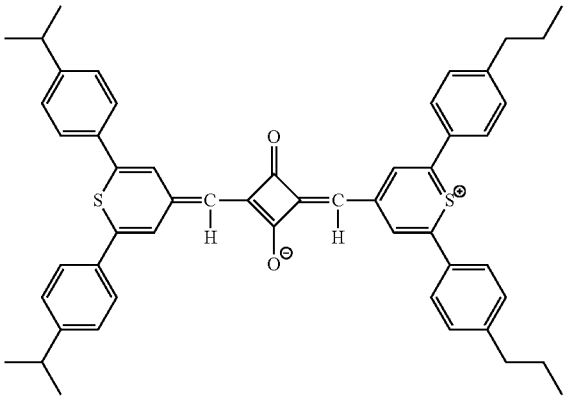

The compound represented by Formula (I-1) is synthesized according to, for example, the following reaction scheme. The compounds represented by other types of Formula (I), such as the compounds represented by Formulae (I-2) to (I-12), are also synthesized based on the following reaction scheme by changing a substituent R' of the compound (A) in the following reaction scheme.

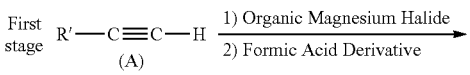

-continued

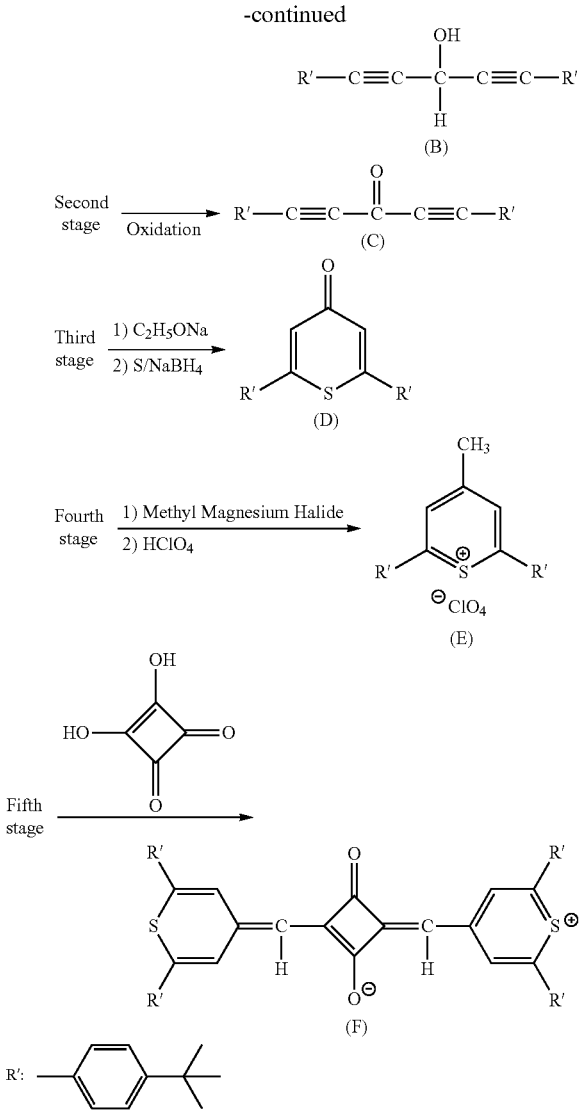

The method illustrated in the above scheme is a method of synthesizing the compound represented by Formula (I-1) through the first to fifth stages.

In the first stage, (A) 4-tert-butylphenylacetylene, organic magnesium halide, and a formic acid derivative are used, thereby obtaining (B) 1,5-bis(4-tert-butylphenyl)-penta-1,4-diyn-3-ol.

In the second stage, (B) 1,5-bis(4-(tert-butylphenyl)-penta-1,4-diyn-3-ol is oxidized, thereby obtaining (C) 1,5-bis(4-tert-butylphenyl)-penta-1,4-diyn-3-one.

In the third stage, (C) 1,5-bis(4-tert-butylphenyl)-penta-1,4-diyn-3-one, sodium ethoxide, sulfur, and sodium borohydride are used, thereby obtaining (D) 2,6-bis(4-tert-butylphenyl)-4H-thiopyran-4-one.

In the fourth stage, (D) 2,6-bis(4-tert-butylphenyl)-4H-thiopyran-4-one, methyl magnesium halide, and perchloric acid are used, thereby obtaining (E) a perchlorate of 2,6-bis(4-tert-butylphenyl)-4-methyl-thiopyrylium.

In the fifth stage, (E) a perchlorate of 2,6-bis(4-tert-butylphenyl)-4-methyl-thiopyrylium and squaric acid are used, thereby obtaining (F) a compound represented by Formula (I-1).

Specific examples of the reactions of the respective stages will be described below.

In the reaction of the first stage, organic magnesium halide (hereinbelow, also referred to as a "Grignard reagent") is allowed to act on (A) 4-tert-butylphenylacetylene, and then a formic acid derivative is allowed to act on (A).

The reaction of the first stage is a reaction using a Grignard reagent, so it is preferable to perform the reaction in an inert atmosphere by using a solvent not containing moisture.

As the solvent used in the reaction of the first stage, any solvent may be used as long as it dissolves (A) 4-(tert-butylphenylacetylene, the Grignard reagent, and the formic acid derivative, and is inert to the Grignard reagent. Examples of the solvent include ether-based solvents such as diethyl ether, diisopropyl ether, and tetrahydrofuran.

As the Grignard reagent, ethyl magnesium bromide or ethyl magnesium iodide is preferable. The Grignard reagent is preferably used in an amount of from 0.5-fold mol to 1.5-fold mol with respect to (A) 4-tert-butylphenylacetylene.

Examples of the formic acid derivative include formic acid esters such as methyl formate, ethyl formate, and n-propyl formate and formic acid amides. As the formic acid derivative, methyl formate and ethyl formate are preferable.

The reaction of the first stage is preferably performed by adding one of (A) 4-tert-butylphenylacetylene and the Grignard reagent dropwise to the other under cooling, just like the generally known Grignard reaction. Likewise, when the reaction mixture of (A) 4-tert-butylphenylacetylene and the Grignard reagent is mixed with the formic acid derivative, the reaction is preferably performed by adding one of the reaction mixture and the formic acid derivative dropwise to the other under cooling. In any cases, the reaction temperature is preferably from −20° C. to 10° C., and particularly preferably from −10° C. to 5° C.

In the step of dropwise addition in any cases, cooling of the reaction mixture may be stopped after mixing is completed, and the reaction may be completed at room temperature (for example, 23° C. to 25° C.) or at a temperature equal to or higher than room temperature. In the operation performed for completing the reaction, the temperature range is preferably from 10° C. to 40° C., and particularly preferably from 15° C. to 30° C.

In the reaction of the first stage, the reaction mixture includes metal salts. Therefore, it is preferable to extract (B) 1,5-bis(4-tert-butylphenyl)-penta-1,4-diyn-3-ol by using an organic solvent.

As the organic solvent used for extraction, any solvent may be used as long as it is not easily mixed with water and dissolves (B) 1,5-bis(4-tert-butylphenyl)-penta-1,4-diyn-3-ol. As this solvent, ether-based solvents such as diethyl ether and diisopropyl ether, halogenated hydrocarbon solvents such as methylene chloride and chloroform, ester-based solvents such as ethyl acetate and butyl acetate, and aromatic hydrocarbon-based solvents such as toluene and xylene are preferable.

The reaction may proceed to the second stage by using the extract including (B) 1,5-bis(4-tert-butylphenyl)-penta-1,4-diyn-3-ol as is or by using the concentrated extract, without performing purification. Alternatively, the reaction may proceed to the second stage after performing purification. Examples of the purification method include distillation, which may be performed under reduced pressure, recrystallization, column chromatography, and the like.

In the reaction of the second stage, examples of the oxidation reagent used for the oxidation of (B) 1,5-bis(4-(tert-butylphenyl)-penta-1,4-diyn-3-ol include metal-based oxidation reagents such as potassium permanganate, manganese dioxide, potassium dichromate, and sodium chromate; a mixed aqueous solution of sodium dichromate and sulfuric acid, which is called a Killiani reagent; and an organic oxidation reagent (1,1,1-triacetoxy-1,1-dihydro-1,2-benziodoxol-3 (1H)-one, the structure is shown below) called Dess-Martin periodinane.

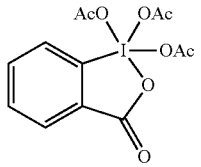

Dess-Martin periodinane

The Dess-Martin periodinane is synthesized with an excellent yield by the method disclosed in a paper reported in The Journal of Organic Chemistry, vol. 58, p. 2899 (1993). Moreover, the Dess-Martin periodinane is commercially available from Lancaster and other companies.

In the reaction of the second stage, the oxidation reagent is preferably used in an amount of from 1-fold mol to 5-fold mol with respect to (B) 1,5-bis(4-tert-butylphenyl)-penta-1,4-diyn-3-ol.

In the reaction of the second stage, as the solvent used for the oxidation reaction, any solvent may be used as long as it dissolves (B) 1,5-bis(4-tert-butylphenyl)-penta-1,4-diyn-3-ol and is not easily oxidized itself. Examples of such a solvent include dialkyl ketones such as acetone and methyl ethyl ketone, halogenated solvents such as chloroform, dichloromethane, 1,2-dichloroethane, and aromatic hydrocarbon-based solvents such as toluene and xylene.

In the reaction of the second stage, the reaction temperature is, for example, from −10° C. to 30° C., and the reaction time is, for example, from 1 hour to 3 hours.

When the metal-based oxidation reagent or the Killiani reagent is used in the reaction of the second stage, the metal compound is removed by filtration after the reaction. Alternatively, if the metal compound after the reaction is dissolved in the reaction mixture, it is preferable to extract (C) 1,5-bis(4-tert-butylphenyl)-penta-1,4-diyn-3-one by using an organic solvent or to perform both the filtration and extraction. As the solvent used for the extraction, any solvent may be used as long as it is not easily mixed with water and dissolves (C) 1,5-bis(4-tert-butylphenyl)-penta-1,4-diyn-3-one, and examples of the solvent include ether-based solvents such as diethyl ether and diisopropyl ether, halogenated hydrocarbon solvents such as methylene chloride and chloroform, ester-based solvents such as ethyl acetate and butyl acetate, and aromatic hydrocarbon-based solvents such as toluene and xylene.

The reaction may proceed to the third stage without purifying the liquid including (C) 1,5-bis(4-tert-butylphenyl)-penta-1,4-diyn-3-one obtained in the reaction of the second stage. Alternatively, the reaction may proceed to the third stage after performing purification. Examples of the purification method include distillation, which may be performed under reduced pressure, recrystallization, column chromatography, and the like.

In the reaction of the third stage, sodium ethoxide is allowed to act on (C) 1,5-bis(4-tert-butylphenyl)-penta-1,4-diyn-3-one, and then sodium sulfide prepared from sulfur and sodium borohydride is allowed to act on (C) so as to cause a cycloaddition reaction, there by obtaining (D) 2,6-bis(4-tert-butylphenyl)-4H-thiopyran-4-one.

Examples of the solvent used in the reaction of the third stage include alcohols, nitrile-based solvents such as acetonitrile and benzonitrile, ether-based solvents such as diethyl ether and tetrahydrofuran, and aromatic hydrocarbon-based solvents such as toluene and xylene. Among these, alcohols, ether-based solvents, and mixed solvents of alcohol and ether are preferable. In addition, since the reaction of the third stage is a reaction using a water-reactive reagent, it is preferable to perform the reaction in an inert atmosphere by using a solvent not containing moisture.

In the reaction of the fourth stage, methyl magnesium halide is allowed to act on (D) 2,6-bis(4-tert-butylphenyl)-4H-thiopyran-4-one, and then perchloric acid is allowed to act on (D), thereby obtaining (E) perchlorate of 2,6-bis(4-tert-butylphenyl)-4-methylthiopyrylium.

In the reaction of the fourth stage, methyl magnesium halide as a type of the Grignard reagent is used, so it is preferable to perform the reaction in an inert atmosphere by using an ether-based solvent not containing moisture.

Examples of the solvent used in the reaction of the fourth stage include diethyl ether, diisopropyl ether, tetrahydrofuran, and the like. Examples of the methyl magnesium halide include methyl magnesium iodide, methyl magnesium bromide, and methyl magnesium chloride. The methyl magnesium halide is preferably used in an amount from 0.9-fold mol to 6-fold mol with respect to (D) 2,6-bis(4-tert-butylphenyl)-4H-thiopyran-4-one.

In the reaction of the fourth stage, the reaction between (D) 2,6-bis(4-tert-butylphenyl)-4H-thiopyran-4-one and the methyl magnesium halide is preferably performed by adding the methyl magnesium halide dropwise to cooled (D) The reaction temperature is preferably from −20° C. to 35° C., and particularly preferably from −10° C. to 25° C. After the dropwise addition is completed, cooling of the reaction mixture may be stopped, thereby completing the reaction at room temperature (for example, 23° C. to 25° C.) or at a temperature equal to or higher than room temperature. In the operation performed for completing the reaction, the temperature range is preferably from 20° C. to 100° C., and particularly preferably from 25° C. to 70° C.

Since the reaction mixture obtained by the above reaction contains metal salts, the reaction product is preferably extracted as an organic layer by an aqueous saturated ammonium chloride solution or the like. Examples of the organic solvent for extraction include ether-based solvents such as diethyl ether and diisopropyl ether, halogenated hydrocarbon solvents such as methylene chloride and chloroform, ester-based solvents such as ethyl acetate and butyl acetate, and aromatic hydrocarbon-based solvents such as toluene and xylene. An aqueous solution of perchloric acid or the like is added dropwise to the extracted organic layer, thereby crystallizing (E) a perchlorate of 2,6-bis(4-tert-butylphenyl)-4-methylthiopyrylium and the like. The step of crystallizing is preferably performed after the reaction mixture is left to stand for about a night.

Squaric acid (3,4-dihydroxy-3-cyclobutene-1,2-dione) used in the reaction of the fifth stage is preferably used in an amount of from 0.4-fold mol to 0.6-fold mol with respect to (E) a perchlorate of 2,6-bis(4-tert-butylphenyl)-4-methyl-thiopyrylium and the like.

Examples of the solvent used in the reaction of the fifth stage include alcohols, and among these, primary alcohols having 3 or more carbon atoms, such as 1-propanol, 1-butanol, and 1-octanol are preferable.

When another solvent is mixed with alcohols, examples of the solvent to be mixed include toluene and xylene. The mixing ratio in the mixing is not limited, but preferably, the amount of the solvent mixed is 0.5 time to 2 times the alcohol in terms of volume.

For the purpose of assisting the progress of the reaction, the reaction of the fifth stage may be performed while distilling away the solvent together with water generated by the reaction or may be performed by adding a small amount of a basic compound. Examples of the basic compound include triethylamine, pyridine, piperidine, and quinoline.

Examples of the method of purifying and isolating (F) a compound represented by Formula (I-1) include recrystallization, column chromatography, sublimation purification, and the like, and among these, recrystallization is preferable for isolation.

Resin

Next, the resin contained in the resin composition according to the present exemplary embodiment will be described.

The resin contained in the resin composition according to the present exemplary embodiment is not particularly restricted in terms of the type and may be selected from, for example, a thermoplastic resin, a thermosetting resin, and a photo-curable resin, according to the use of the resin composition. One kind of resin may be used alone, or two or more kinds thereof may be used concurrently.

The use of the resin composition according to the present exemplary embodiment is not particularly limited, and specific examples of the use include an image-forming material described later, a coating material for heating elements that generate heat by absorbing infrared light, and a composition for forming a filter film for an infrared filter that transmits visible light and blocks infrared light.

The resin composition according to the present exemplary embodiment may contain other components according to the purpose. Examples of other components include various known additives such as a plasticizer, a dispersant, a viscosity adjustor, a pH adjustor, an antioxidant, a preservative, an antifungal agent, an organic solvent, and a pigment.

The method of preparing the resin composition according to the present exemplary embodiment is not particularly limited. Examples of the method include a method of dissolving or dispersing the compound represented by Formula (I), a resin, and other components in a solvent; a method of dispersing a resin in a solution such that the resin turns into particles, adding the compound represented by Formula (I) and other materials to the solution, and aggregating all of them together; a method of polymerizing monomers as a raw material of the resin in a solution in which the compound represented by Formula (I) and other materials coexist; a method (used in a case where the resin is a thermoplastic resin) of melting and kneading the compound represented by Formula (I), the resin, and other materials all together and performing molding or pulverization; and the like.

Hereinbelow, the image-forming material according to the present exemplary embodiment, which is an example of the resin composition according to the present exemplary embodiment, will be described.

The image-forming material according to the present exemplary embodiment contains the compound represented by Formula (I) and a thermoplastic resin. The compound represented by Formula (I) generates heat by absorbing light. The thermoplastic resin is softened or melted by heating and then solidified again, whereby the image-forming material is fixed onto a recording medium.

The compound represented by Formula (I) exhibits superior dispersibility in a resin, compared to a pyrylium-based squarylium compound other than the compound represented by Formula (I).

Accordingly, the image-forming material according to the present exemplary embodiment is superior in dispersibility of a near infrared-absorbing material, compared to a image-forming material containing a pyrylium-based squarylium compound other than the compound represented by Formula (I).

In addition, the maximum absorption wavelength of the compound represented by Formula (I) in a tetrahydrofuran solution is 908 nm.

For the above reasons, the image-forming material according to the present exemplary embodiment is superior in absorbing light having a wavelength of from 760 nm to 970 nm, compared to an image-forming material containing pyrylium-based squarylium compound other than the compound represented by Formula (I).

On the other hand, the compound represented by Formula (I) exhibits a low absorbance in a wavelength region of visible light of from 400 nm to 750 nm. Consequently, it is difficult for the image-forming material according to the present exemplary embodiment to exhibit the color shade formed by the compound represented by Formula (I).

Therefore, if the image-forming material according to the present exemplary embodiment further contains a pigment, an image-forming material that retains a color shade formed by the pigment is provided.

When the image-forming material according to the present exemplary embodiment is a light-fixable toner, a light-fixable toner is provided which efficiently absorbs light having a wavelength of from 760 nm to 970 nm by containing a small amount of the compound represented by Formula (I) and is excellently fixed to a recording medium.

Moreover, when the image-forming material according to the present exemplary embodiment is a light-fixable toner further containing a pigment, a light-fixable toner that retains a color shade formed by the pigment is provided.

When the image-forming material according to the present exemplary embodiment is an invisible toner, an invisible toner is provided which efficiently absorbs light having a wavelength of from 760 nm to 970 nm by containing a small amount of the compound represented by Formula (I) and allows excellent reading of information.

Furthermore, when the image-forming material according to the present exemplary embodiment is an invisible toner, an invisible toner is provided which is fixed on a recording medium by being irradiated with light and has excellent invisibility.

The term "invisibility" in the present specification refers to a property of not being easily recognized by visual observation of human beings. Ideally, the term refers to a property of not being recognized (not being seen) at all.

In the image-forming material according to the present exemplary embodiment, the content of the compound represented by Formula (I) is preferably from 0.05% by weight to 10% by weight, and more preferably from 0.5% by weight to 5% by weight, based on the total weight of the image-forming material. The compound represented by Formula (I) exhibits excellent dispersibility in a thermoplastic resin. Therefore, even if the content of this compound in the image-forming material is small, the light having a wavelength of from 760 nm to 970 nm is efficiently absorbed.

The lower the content of the compound represented by Formula (I), the more superior the invisibility of the image-forming material according to the present exemplary embodiment. In addition, when containing a pigment, the material becomes an image-forming material retaining a color shade formed by the pigment.

Thermoplastic Resin

The image-forming material according to the present exemplary embodiment contains a thermoplastic resin. The image-forming material according to the present exemplary embodiment obtains a more sufficient fixing effect with small light energy, compared to a case where the material contains a non-thermoplastic resin.

Examples of the thermoplastic resin include thermoplastic resins formed of natural polymers and thermoplastic resins formed of synthetic polymers. Specific examples thereof include a polyester resin, an epoxy resin, a styrene-acryl resin, a polyamide resin, a polyvinyl resin, a polyolefin resin, a polyurethane resin, a polybutadiene resin, a poly(alkyl methacrylate) resin, an acrylic resin, and a polystyrene resin. One kind of thermoplastic resin may be used alone, or two or more kinds thereof may be used concurrently.

Among these thermoplastic resins, a polyester resin, a styrene-acryl resin, a polyamide resin, a polyvinyl resin, a poly (alkyl methacrylate) resin, and an acrylic resin are preferable, from the viewpoint of the dispersibility of the compound represented by Formula (I).

A weight average molecular weight of the thermoplastic resin preferably ranges from 1,000 to 100,000, and more preferably ranges from 5,000 to 50,000. If the weight average molecular weight is 1,000 or more, problems such as offset or fusion do not easily arise. If the weight average molecular weight is 100,000 or less, the image-forming material is efficiently fixed by being irradiated with light, without requiring an excessive amount of heat for fixing.

A glass transition temperature of the thermoplastic resin preferably ranges from 50° C. to 150° C. If the glass transition temperature is within the above range, the thermoplastic resin is softened or melted with a more appropriate amount of heat and then solidified again, compared to a case where the glass transition temperature is outside the above range, whereby the image-forming material is fixed on a recording medium. The glass transition temperature of the thermoplastic resin more preferably ranges from 55° C. to 70° C.

Pigment

The image-forming material according to the present exemplary embodiment may contain a pigment so as to impart a color shade necessary for forming an objective image to the image-forming material. Various known pigments may be used as the pigment without particular limitation. One kind of pigment may be used alone, or two or more kinds thereof may be used concurrently.

Other Components

When the image-forming material according to the present exemplary embodiment is an electrophotographic toner (a light-fixable toner, an invisible toner, or the like), the image-forming material may optionally further contain a charge-controlling agent, an offset-preventing agent, and the like.

Charge-controlling agents include positively chargeable agents and negatively chargeable agents. Examples of the positively chargeable charge-controlling agent include a quaternary ammonium-based compound. Examples of the negatively chargeable charge-controlling agent include a metal complex of alkyl salicylate and a resin type charge-controlling agent containing a polar group.

Examples of the offset-preventing agent include low-molecular weight polyethylene and low-molecular weight polypropylene.

When the image-forming material according to the present exemplary embodiment is an electrophotographic toner, inorganic or organic particles may be added as an external additive to the toner surface so as to improve fluidity and powder storability, to control triboelectric charging, and to improve a transfer performance, a cleaning property, and the like.

Examples of the inorganic particles include silica, alumina, titania, calcium carbonate, magnesium carbonate, calcium phosphate, and cerium oxide. These inorganic particles may be optionally subjected to known surface treatments.

Examples of the organic particles include emulsion polymers and soap-free polymers containing vinylidene fluoride, methyl methacrylate, styrene-methyl methacrylate, and the like as constituent components.

When the image-forming material according to the present exemplary embodiment is an electrophotographic toner, the image-forming material is prepared by a method of preparing an electrophotographic toner that is used in the related art. Examples of the method include a method of melting and kneading the compound represented by Formula (I), a thermoplastic resin, and other materials all together and pulverizing the resultant (kneading and pulverizing method); a method of polymerizing monomers as a raw material of the thermoplastic resin in a solution in which the compound represented by Formula (I) and other materials coexist and aggregating the resultant; a method of polymerizing monomers as a raw material of the thermoplastic resin, subsequently adding the compound represented by Formula (I) and other materials thereto, and aggregating the resultant; a method of dispersing the thermoplastic resin in a solution such that the resin turns into particles, and aggregating the resultant together with the compound represented by Formula (I) and other materials; and the like.

Next, image-forming materials other than the electrophotographic toner will be described.

Examples of the resin composition according to the present exemplary embodiment also include image-forming materials other than the electrophotographic toner. Examples of such image-forming materials include a near infrared-absorbing ink. Examples of the near infrared-absorbing ink include inks for an ink-jet printer; inks for typographic printing, offset printing, flexo-printing, gravure printing, or silk printing; and the like.

When the near infrared-absorbing ink is an ink for an ink-jet printer, the ink may be constituted as a water-based ink containing water. In this case, in order to prevent drying of the ink and to improve permeability of the ink, the ink may further contain a water-soluble organic solvent.

Examples of the water include deionized water, ultra-filtered water, pure water, and the like. Examples of the organic solvent include polyols such as ethylene glycol, diethylene glycol, polyethylene glycol, and glycerin; N-alkyl pyrrolidones; esters such as ethyl acetate and amyl acetate; lower alcohols such as methanol, ethanol, propanol, and butanol; and glycol ethers of ethylene oxide or propylene oxide adducts of methanol, butanol, and phenol. One kind of organic solvent may be used alone, or two or more kinds thereof may be used concurrently.

The organic solvent is selected in consideration of hygroscopicity, a moisturizing property, solubility of the compound represented by Formula (I), permeability, viscosity of the ink, a freezing point, and the like. The proportion of the organic solvent contained in the ink for an ink-jet printer is preferably from 1% by weight to 60% by weight.

When the near infrared-absorbing ink is an ink for an ink-jet printer, additives known as ink components in the related art may be contained in the ink so as to satisfy various conditions required for the system of the ink-jet printer. Examples of the additives include a pH adjustor, a specific resistance adjustor, an antioxidant, a preservative, an antifungal agent, and a metal sequestering agent. Examples of the pH adjustor include alkanolamines, ammonium salts, and metal hydroxides. Examples of the specific resistance adjustor include organic and inorganic salts, and examples of the metal sequestering agent include a chelating agent.

When the near infrared-absorbing ink is an ink for an ink-jet printer, a water-soluble resin such as polyvinyl alcohol, polyvinyl pyrrolidone, carboxymethyl cellulose, a styrene-acrylic acid resin, or a styrene-maleic acid resin may be contained in the ink to such a degree that a nozzle portion is not clogged and the ink discharge direction is not changed.

When the near infrared-absorbing ink is an ink for typographic printing, offset printing, flexo-printing, gravure printing, or silk printing, the ink may be constituted as an oil-based ink containing a polymer or an organic solvent.

Examples of the polymer include natural resins such as a protein, rubber, celluloses, shellac, copal, starch, and rosin; thermoplastic resins such as a vinyl-based resin, an acrylic resin, a styrene-based resin, a polyolefin-based resin, and a novolac phenolic resin; and thermosetting resins such as a resol phenolic resin, a urea resin, a melamine resin, a polyurethane resin, an epoxy resin, and unsaturated polyester.

Examples of the organic solvent include the organic solvents exemplified in the description of the ink for an ink-jet printer.

When the near infrared-absorbing ink is an ink for typographic printing, offset printing, flexo-printing, gravure printing, or silk printing, additives known as ink components in the related art may be contained in the ink so as to satisfy various conditions required. Examples of the additives include a plasticizer for improving the flexibility and strength of a print film, an anti-drying agent, a viscosity adjustor, a dispersant, and a solvent for adjusting viscosity.

Image-Forming Method

The image-forming method according to the present exemplary embodiment includes a step of fixing the image-forming material to a recording medium by irradiating the image-forming material according to the present exemplary embodiment with light having a wavelength of from 760 nm to 970 nm.

The compound represented by Formula (I) that is contained in the image-forming material according to the present exemplary embodiment excellently absorbs light having a wavelength of from 760 nm to 970 nm. Consequently, according to the image-forming method of the present exemplary embodiment, an image-forming method that efficiently fixes the image-forming material on a recording medium is provided.

Examples of the source of light include a semiconductor laser, a solid-state laser, a liquid-state laser, a gas laser, and the like. The semiconductor laser having an oscillation wavelength in a near infrared region, which is widely used currently, has two oscillation wavelengths of a 800 nm band and a 900 nm band, and a luminous efficiency tends to be higher in the 900 nm band than in the 800 nm band.

In the image-forming material according to the present exemplary embodiment, the maximum absorption wavelength of the compound represented by Formula (I) contained in the material is 908 nm. Consequently, the image-forming material excellently absorbs light having a wavelength of from 760 nm to 970 nm, and in this wavelength range, the material excellently absorbs light having a wavelength of the 900 nm band.

Therefore, according to the image-forming method of the present exemplary embodiment, an image-forming method is provided which more efficiently fixes the image-forming material to a recording medium in combination with the semiconductor laser described above.

In the image-forming method according to the present exemplary embodiment, the wavelength of light irradiated is preferably from 800 nm to 950 nm, from the viewpoint of efficiently fixing the image-forming material to a recording medium with less light energy.

Examples of the recording medium include paper, a plastic plate, cloth, a metal plate, and the like. The material or characteristics of the recording medium is preferably within a range of being resistant to heat at the time of fixing.

Examples of the method of imparting the image-forming material to the recording medium include an electrophotographic method, an ink-jet method, typographic printing, offset printing, flexo-printing, gravure printing, silk printing, and the like. From the viewpoint of efficiently heating the image-forming material on the recording medium by irradiation of light, it is preferable not to provide a liquid (water or the like) other than the image-forming material to the recording medium. Therefore, as the method of imparting the image-forming material to the recording medium, an electrophotographic method is preferable.

Examples of the image-forming method according to the present exemplary embodiment include a method of imparting the image-forming material to the recording medium, and irradiating for 3 milliseconds the surface of the recording medium where the image-forming material has been imparted, with a laser beam of an output of 1 J/cm$^2$ so as to fix an image.

EXAMPLES

Hereinbelow, the present invention will be described in detail based on examples, but the present invention is not limited to the examples.

Example 1

Synthesis of Compound Represented by Formula (I-1)

The compound represented by Formula (I-1) is synthesized according to the following synthesis scheme.

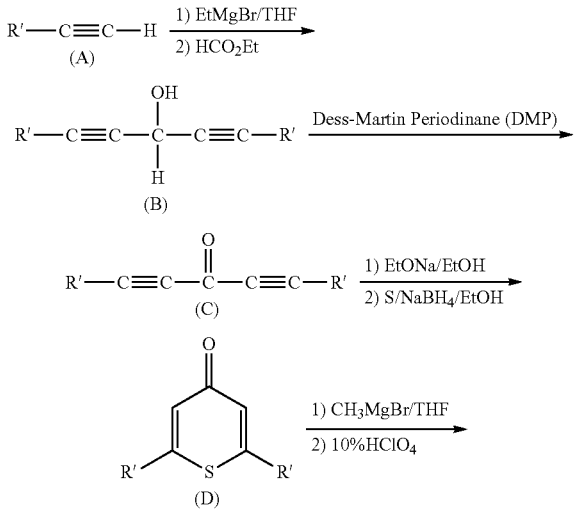

-continued

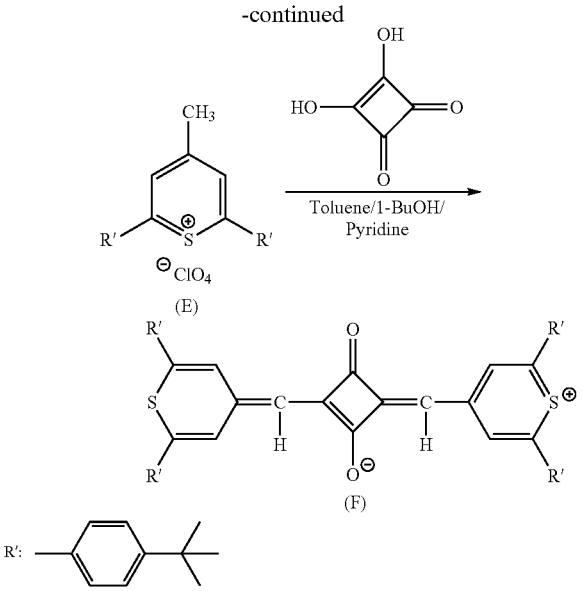

In a nitrogen atmosphere, while 256 g of a 13% (about 1 M) tetrahydrofuran solution of ethyl magnesium bromide is being cooled with ice water, a solution obtained by dissolving 39.5 g of (A) 4-tert-butylphenylacetylene in 60 ml of tetrahydrofuran is added dropwise to the above solution. After the dropwise addition ends, the reaction container is taken out of the ice water bath, followed by stirring at room temperature (23° C. to 25° C.) for 3 hours. Subsequently, while the reaction container is being cooled again in the ice water bath, 9.25 g of ethyl formate is added dropwise thereto. After the dropwise addition ends, 20 ml of tetrahydrofuran is added thereto, and 51 ml of 6 N hydrochloric acid is added dropwise thereto. The organic substances are extracted from the mixture having undergone the reaction, and the separated organic layer is washed with water and concentrated, followed by recrystallization from hexane, thereby obtaining 32.3 g of (B) 1,5-bis(4-tert-butylphenyl)-penta-1,4-diyn-3-ol. The yield of this stage is 75%.

The structure of the intermediate product of each stage is checked by an NMR spectrum, a mass spectrum, or the like.

In a nitrogen atmosphere, while a solution obtained by dissolving 27.5 g of Dess-Martin periodinane in 170 ml of (ultra-dehydrated) acetone is being cooled with ice water, a solution obtained by dissolving 19.5 g of (B) 1,5-bis(4-tert-butylphenyl)-penta-1,4-diyn-3-ol in 70 ml of (ultra-dehydrated) acetone is added to the above solution, followed by stirring at room temperature (23° C. to 25° C.) for 3 hours. A solution obtained by dissolving 5 g of sodium hydroxide in 25 ml of water is added to the reaction mixture, and the yellow precipitate is removed by suction filtration, and washed with acetone. The acetone filtrate is concentrated by distillation under reduced pressure, and 300 ml of ethyl acetate is poured into the obtained concentrated liquid to extract the organic substances, and the separated organic layer is washed with water. The concentrated organic layer is purified by being recrystallized sequentially from a mixed solvent of acetone and hexane and then from a mixed solvent of acetone and ethanol, thereby obtaining 16.0 g of (C) 1,5-bis(4-tert-butylphenyl)-penta-1,4-diyn-3-one. The yield of this stage is 82.5%.

In a nitrogen atmosphere, 40 ml of anhydrous ethanol, 142 mg of sulfur (crystalline powder), and 171 mg of sodium borohydride are sequentially added to 1.366 g of a 20% ethanol solution of sodium ethoxide. This mixed solution is stirred at room temperature (23° C. to 25° C.) for about 2 hours, thereby obtaining a solution I in which sulfur is thoroughly dissolved.

In a nitrogen atmosphere, 40 ml of anhydrous ethanol and 1.37 g of (C) 1,5-bis(4-tert-butylphenyl)-penta-1,4-diyn-3-one are sequentially added to 0.954 g of a 20% ethanol solution of sodium ethoxide, followed by stirring at room temperature (23° C. to 25° C.) for 14 minutes, thereby obtaining a solution II. The solution II is added to the solution I. After this mixed reaction solution is stirred at room temperature (23° C. to 25° C.) for 15 minutes, the solution is poured into 200 ml of water, the organic substances are extracted by a mixed solvent of toluene and ethyl acetate (volume ratio of 1:1), and the separated organic layer is washed with water. Thereafter, the organic layer is dried over anhydrous sodium sulfate and concentrated, and then purified by being recrystallized from a mixed solvent of acetone and hexane, thereby obtaining 1.07 g of (D) 2,6-bis(4-tert-butylphenyl)-4H-thiopyran-4-one. The yield of this stage is 71%.

In a nitrogen atmosphere, 716 mg of (D) 2,6-bis(4-tert-butylphenyl)-4H-thiopyran-4-one is dissolved in 12 ml of anhydrous tetrahydrofuran. While this solution is being stirred at room temperature (23° C. to 25° C.), 12 ml of a 1 M tetrahydrofuran solution of methylmagnesium bromide is added dropwise to the above solution. This mixed reaction solution is heated under stirring, subjected to a reflux reaction for 3 hours, and then cooled to room temperature. While the reaction mixture is being cooled in an ice water bath, 30 ml of a 10% aqueous perchloric acid solution is added to the solution, and then the resultant is left to stand overnight for precipitation. The precipitated crystals are obtained by filtration, thereby obtaining 784 mg of (E) a perchlorate of 2,6-bis(4-tert-butylphenyl)-4-methylthiopyrylium. The yield of this stage is 86.8%.

380 mg of (E) a perchlorate of 2,6-bis(4-tert-butylphenyl)-4-methylthiopyrylium and 45.6 mg of squaric acid are dispersed in a mixed solvent of 9 ml of toluene and 6 ml of 1-butanol, and 32 mg of pyridine is added thereto, followed by reflux under heating for 3 hours. The water generated during the reaction is removed by azeotropic distillation. The reaction mixture is left to be cooled and then concentrated, followed by purification by silica gel column chromatography, thereby obtaining 232 mg of (F) a compound represented by Formula (I-1). The yield of this stage is 70%, and the total yield of all the 5 stages is 26%.

Identification of Compound

The dark brown solid obtained as above is identified by an infrared absorption spectrum (KBr tablet method), a $^1$H-NMR spectrum, a mass spectrum, and a visible near-infrared absorption spectrum. As a result, the dark brown solid described above is confirmed to have a molecular structure represented by Formula (I-1). The data of identification are shown below, and the visible near-infrared absorption spectrum is shown in FIG. 1.

Infrared absorption spectrum (KBr tablet method):

$\nu_{max}$=3033 (=C—H), 2958 ($CH_3$), 2866 ($CH_3$), 2346, 1726, 1593, 1560 (C=C ring), 1474, 1410, 1352 ($CH_3$), 1333, 1312, 1269, 1242, 1210, 1196, 1124 (C—O$^-$), 1084, 1005, 970, 889, 832, 796, 750, 726 cm$^{-1}$ $^1$H-NMR spectrum ($CDCl_3$):

7.90 (brs, 2H), 7.55, 7.52 (d, 16H, $H_{arom}$), 1.84 (brs, 4H), 1.36 (s, 36H, 12×$CH_3$)

Mass spectrum (FD):

m/z=827 ($M^+$, 100%)

Visible Near-Infrared Absorption Spectrum (FIG. 1):

Maximum absorption wavelength ($\lambda_{max}$)=908 nm (in a tetrahydrofuran solution)

Molar absorption coefficient at the maximum absorption wavelength ($\epsilon_{max}$)=2.69×10$^5$ M$^{-1}$ cm$^{-1}$ (in a tetrahydrofuran solution)

Measurement of Solubility in Tetrahydrofuran

The solubility of the compound represented by Formula (I-1) in tetrahydrofuran (24±1° C.) is measured in the following manner.

After 10.00 mg of the compound (dark brown solid) represented by Formula (I-1) is mixed with 5.00 ml of tetrahydrofuran in a screw vial, the vial is irradiated with ultrasonic waves for 30 minutes while the vial is sealed with a cap, and left to stand overnight at room temperature. The obtained solution is filtered through a membrane filter having a pore size of 25 nm, and a dry weight of the dark brown solid remaining on the filter is measured. As a result, the weight of the compound represented by Formula (I-1) dissolved in 5.00 ml of tetrahydrofuran is found, whereby the solubility in tetrahydrofuran may be calculated.

The result is shown in Table 1, and the evaluation criteria of Table 1 are as follows.

A: solubility in tetrahydrofuran≥1 mg/ml

B: 0.1 mg/ml≤solubility in tetrahydrofuran<1 mg/ml

C: solubility in tetrahydrofuran<0.1 mg/ml

Example 2

A compound represented by Formula (I-2) is synthesized in the same manner as in Example 1, except that 4-n-butylphenylacetylene is used instead of 4-tert-butylphenylacetylene.

The synthesized compound is identified to be a compound represented by Formula (I-2) by an infrared absorption spectrum (KBr tablet method), a $^1$H-NMR spectrum, a mass spectrum, and a visible near-infrared absorption spectrum. The measurement results of the molecular weight, maximum absorption wavelength, and the molar absorption coefficient at the maximum absorption wavelength are shown below.

Molecular weight: 827.2

Maximum absorption wavelength ($\lambda_{max}$)=910 nm (in a tetrahydrofuran solution)

Molar absorption coefficient at the maximum absorption wavelength ($\epsilon_{max}$)=2.1×10$^5$ M$^{-1}$ cm$^{-1}$ (in a tetrahydrofuran solution)

The solubility of the compound represented by Formula (I-2) in tetrahydrofuran is measured in the same manner as in Example 1. The result is shown in Table 1.

Example 3

A compound represented by Formula (I-3) is synthesized in the same manner as in Example 1, except that 4-ethylphenylacetylene is used instead of 4-tert-butylphenylacetylene.

The synthesized compound is identified to be a compound represented by Formula (I-3) by an infrared absorption spectrum (KBr tablet method), a $^1$H-NMR spectrum, a mass spectrum, and a visible near-infrared absorption spectrum. The measurement results of the molecular weight, maximum absorption wavelength, and the molar absorption coefficient at the maximum absorption wavelength are shown below.

Molecular weight: 715.0

Maximum absorption wavelength ($\lambda_{max}$)=908 nm (in a tetrahydrofuran solution)

Molar absorption coefficient at the maximum absorption wavelength ($\epsilon_{max}$=1.8×10$^5$ M$^{-1}$ cm$^{-1}$ (in a tetrahydrofuran solution)

The solubility of the compound represented by Formula (I-3) in tetrahydrofuran is measured in the same manner as in Example 1. The result is shown in Table 1.

Comparative Example 1

According to the method of Example 3 of JP-A-2001-011070, a pyrylium-based squarylium compound represented by the following Formula (II-1) is synthesized. Hereinbelow, this compound is also called a "compound represented by Formula (II-1)".

Formula (II-1)

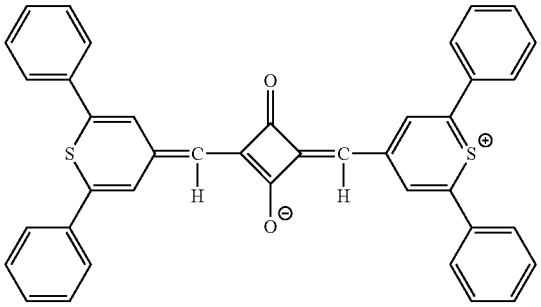

The synthesized compound is identified to be a compound represented by Formula (II-1) by an infrared absorption spectrum (KBr tablet method), a $^1$H-NMR spectrum, amass spectrum, and a visible near-infrared absorption spectrum. The measurement results of the molecular weight, maximum absorption wavelength, and the molar absorption coefficient at the maximum absorption wavelength are shown below.

molecular weight: 602.8

Maximum absorption wavelength ($\lambda_{max}$)=901 nm (in a tetrahydrofuran solution)

Molar absorption coefficient at the maximum absorption wavelength ($\epsilon_{max}$)=2.07×10$^5$ M$^{-1}$ cm$^{-1}$ (in a tetrahydrofuran solution)

The solubility of the compound represented by Formula (II-1) in tetrahydrofuran is measured in the same manner as in Example 1. The result is shown in Table 1.

Comparative Example 2

A pyrylium-based squarylium compound represented by the following Formula (II-2) is synthesized in the same manner as in Example 1, except that 4-ethynyltoluene is used instead of 4-tert-butylphenylacetylene. Hereinbelow, this compound is also called a "compound represented by Formula (II-2)".

Formula (II-2)

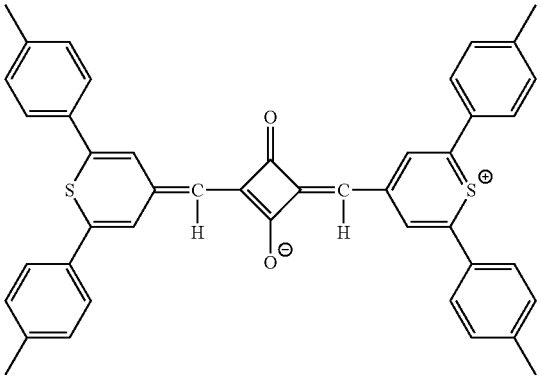

The synthesized compound is identified to be a compound represented by Formula (II-2) by an infrared absorption spectrum (KBr tablet method), a $^1$H-NMR spectrum, a mass spectrum, and a visible near-infrared absorption spectrum. The measurement results of the molecular weight, maximum absorption wavelength, and the molar absorption coefficient at the maximum absorption wavelength are shown below.

Molecular weight: 658.9

Maximum absorption wavelength ($\lambda_{max}$)=905 nm (in a tetrahydrofuran solution)

Molar absorption coefficient at the maximum absorption wavelength ($\epsilon_{max}$)=1.9×10$^5$ M$^{-1}$ cm$^{-1}$ (in a tetrahydrofuran solution)

The solubility of the compound represented by Formula (II-2) in tetrahydrofuran is measured in the same manner as in Example 1. The result is shown in Table 1.

Comparative Example 3

A pyrylium-based squarylium compound represented by the following Formula (II-3) is synthesized in the same manner as in Example 1, except that 4-n-hexylphenylacetylene is used instead of 4-(tert-butylphenylacetylene. Hereinbelow, this compound is also called a "compound represented by Formula (II-3)".

TABLE 1

| | | Solubility in tetrahydrofuran | |
|---|---|---|---|
| | | mg/ml | Relative evaluation |
| Example 1 | Compound represented by Formula (I-1) | 1.3 | A |
| Example 2 | Compound represented by Formula (I-2) | 1.1 | A |
| Example 3 | Compound represented by Formula (I-3) | 0.6 | B |
| Comparative Example 1 | Compound represented by Formula (II-1) | <0.05 | C |
| Comparative Example 2 | Compound represented by Formula (II-2) | 0.3 | B |
| Comparative Example 3 | Compound represented by Formula (II-3) | 1.1 | A |

From the results shown in Table 1, it is understood that the compounds represented by Formulae (I-1), (I-2), and (I-3) exhibit superior solubility in tetrahydrofuran, compared to the compounds represented by Formulae (II-1), and (II-2).

Formula (II-3)

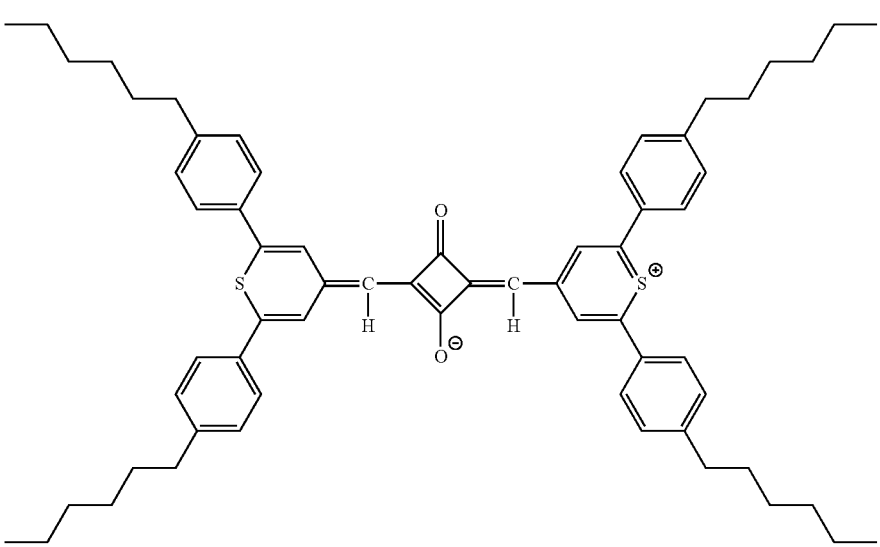

The synthesized compound is identified to be a compound represented by Formula (II-3) by an infrared absorption spectrum (KBr tablet method), a $^1$H-NMR spectrum, amass spectrum, and a visible near-infrared absorption spectrum. The measurement results of the molecular weight, maximum absorption wavelength, and the molar absorption coefficient at the maximum absorption wavelength are shown below.

Molecular weight: 939.4

Maximum absorption wavelength ($\lambda_{max}$)=910 nm (in a tetrahydrofuran solution)

Molar absorption coefficient at the maximum absorption wavelength ($\epsilon_{max}$)=2.0×10$^5$ M$^{-1}$ cm$^{-1}$ (in a tetrahydrofuran solution)

The solubility of the compound represented by Formula (II-3) in tetrahydrofuran is measured in the same manner as in Example 1. The result is shown in Table 1.

Example 11

Preparation of Pseudo-Toner Dispersion 1.83 mg of the compound represented by Formula (I-1) and 181.2 mg of a resin (poly(styrene-n-butyl acrylate)) for toner are dissolved in 20.0 ml of tetrahydrofuran, and 500 μl of the obtained solution is drawn up using a micropipette and injected at once into 50 ml of distilled water which already contains 20 mg of potassium carbonate and has been stirred at 400 rpm, followed by reprecipitation. 1 minute later, slurry in which a colorant is dispersed in a resin is obtained. The volume average particle size of the slurry (pseudo-toner dispersion) is 95 nm.

Application of Pseudo-Toner Dispersion to Paper

The pseudo-toner dispersion is filtered through an MF-Millipore membrane filter (paper, manufactured by Merck, Ltd., model number VMWP) having a pore size of 50 nm by using a glass filter having an inner diameter of 36 mm, followed by air drying and thermocompression (120° C.). In this manner, a latex patch in which an amount of toner applied=4.5 g/m$^2$ and an amount of the compound represented by Formula (I-1) per unit area=0.045 g/m$^2$ (corresponding to 1% by weight) is prepared.

Evaluation

Reflection Spectrum

Figure 2:
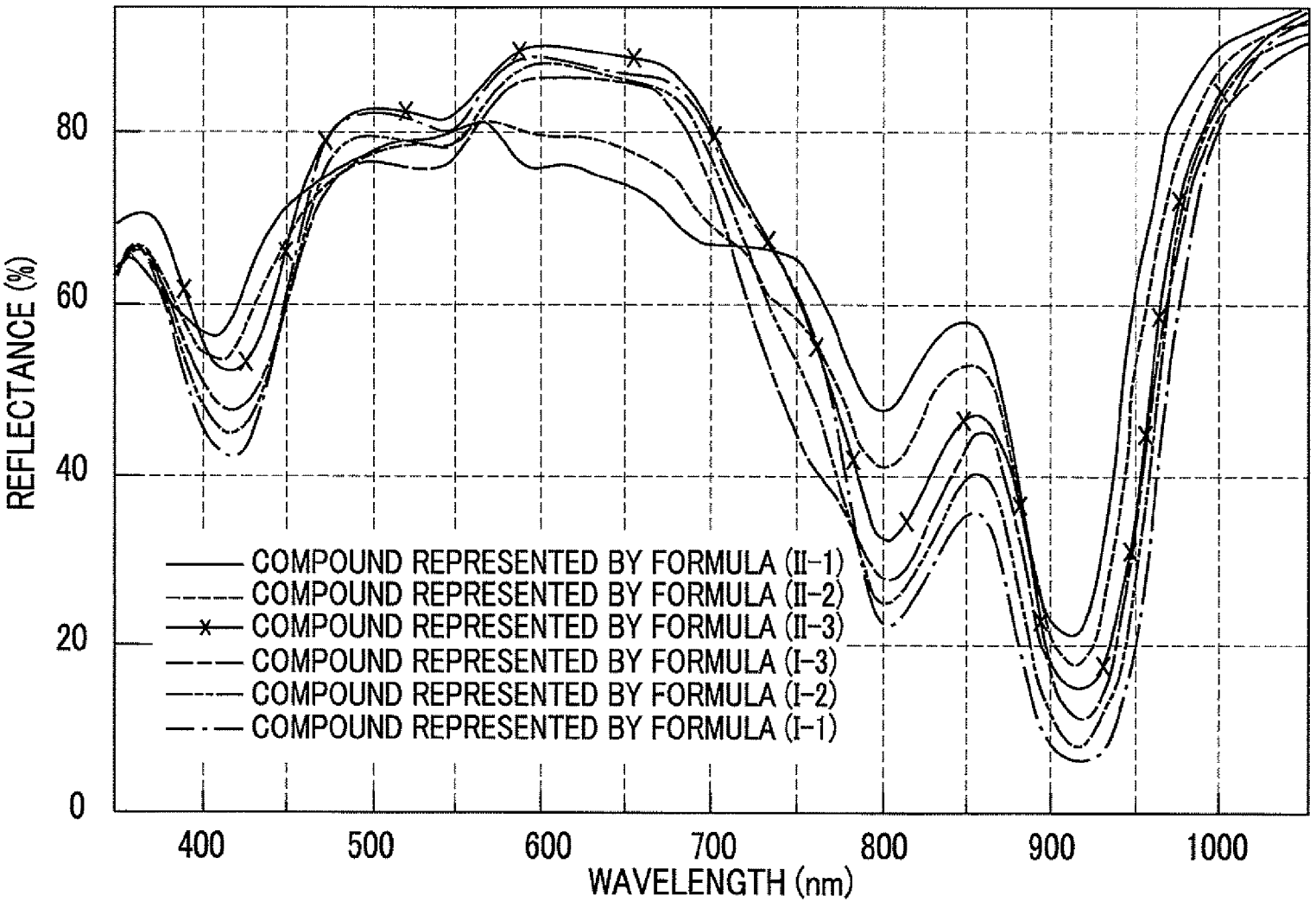
FIG. 2 is a reflection spectrum of a latex patch that is obtained using a compound represented by Formula (I) or a pyrylium-based squarylium compound other than the compound represented by Formula (I).

A reflection spectrum of the latex patch obtained as above is measured by a spectrophotometer U-4100 manufactured by Hitachi, Ltd. The reflection spectrum is shown in FIG. 2, and the initial reflectance (%) at 920 nm is shown in Table 2. The smaller the initial reflectance (%), the better the light-absorbing property.

Color Difference

Color Difference (ΔE) is what is called color difference in CIE1976 L*a*b* color space. The color difference (ΔE) of a recording medium (for example, paper) is calculated by the following formula, from L, a, and b obtained by measurement using a spectrodensitometer (X-Rite 939 manufactured by X-Rite, Inc.).

Color Difference $$\Delta E=\sqrt{(L_1-L_2)^2+(a_1-a_2)^2+(b_1-b_2)^2}$$

Here, $L_1$, $a_1$, and $b_1$ are values of L, a, and b of the surface of a recording medium before the application of the image-forming material. $L_2$, $a_2$, and $b_2$ are values of L, a, and b in an image portion at the time when an image is formed on the surface of the recording medium by the application of the image-forming material.

The color difference (ΔE) obtained from the latex patch of Example 11 is shown in Table 2.

The smaller the value of the color difference (ΔE), the greater the difficulty in visually recognizing the difference, which means in other words that the image-forming material has excellent invisibility.

Example 12

Preparation of a pseudo-toner dispersion, application of the pseudo-toner dispersion to paper, and evaluation are performed in the same manner as in Example 11, except that the compound represented by Formula (I-2) is used instead of the compound represented by Formula (I-1). The reflection spectrum is shown in FIG. 2, and the initial reflectance (%) at 920 nm is shown in Table 2.

Example 13

Preparation of a pseudo-toner dispersion, application of the pseudo-toner dispersion to paper, and evaluation are performed in the same manner as in Example 11, except that the compound represented by Formula (I-3) is used instead of the compound represented by Formula (I-1). The reflection spectrum is shown in FIG. 2, and the initial reflectance (%) at 920 nm is shown in Table 2.

Comparative Example 11

Preparation of a pseudo-toner dispersion, application of the pseudo-toner dispersion to paper, and evaluation are performed in the same manner as in Example 11, except that the compound represented by Formula (II-1) is used instead of the compound represented by Formula (I-1). The reflection spectrum is shown in FIG. 2, and the initial reflectance (%) at 920 nm is shown in Table 2.

Comparative Example 12

Preparation of a pseudo-toner dispersion, application of the pseudo-toner dispersion to paper, and evaluation are performed in the same manner as in Example 11, except that the compound represented by Formula (II-2) is used instead of the compound represented by Formula (I-1). The reflection spectrum is shown in FIG. 2, and the initial reflectance (%) at 920 nm is shown in Table 2.

Comparative Example 13

Preparation of a pseudo-toner dispersion, application of the pseudo-toner dispersion to paper, and evaluation are performed in the same manner as in Example 11, except that the compound represented by Formula (II-3) is used instead of the compound represented by Formula (I-1). The reflection spectrum is shown in FIG. 2, and the initial reflectance (%) at 920 nm is shown in Table 2.

TABLE 2

| | | Initial reflectance (%) at 920 nm | ΔE |
|---|---|---|---|
| Example 11 | Compound represented by Formula (I-1) | 6.56 | 17.2 |
| Example 12 | Compound represented by Formula (I-2) | 8.85 | 17.6 |
| Example 13 | Compound represented by Formula (I-3) | 11.11 | 18.0 |
| Comparative Example 11 | Compound represented by Formula (II-1) | 22.38 | 18.4 |
| Comparative Example 12 | Compound represented by Formula (II-2) | 18.63 | 18.2 |
| Comparative Example 13 | Compound represented by Formula (11-3) | 14.01 | 17.2 |

From the results shown in Table 2 and FIG. 2, it is understood that Examples 11, 12, and 13 using a dispersion including the compound represented by Formula (I) and a resin superiorly absorb light in a 900 nm band while maintaining invisibility, compared to Comparative Examples 11, 12, and 13 using a dispersion including a pyrylium-based squarylium compound other than the compound represented by Formula (I) and a resin.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A resin composition comprising:

a pyrylium-based squarylium compound represented by the following Formula (I); and a resin, Formula (I)

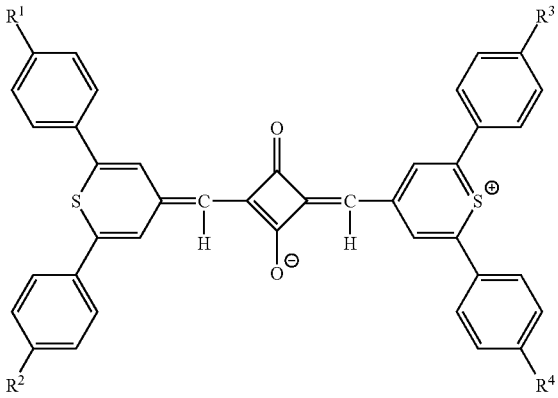

wherein in Formula (I), each of $R^1$, $R^2$, $R^3$, and $R^4$ independently represents an alkyl group having from 2 to 5 carbon atoms.

2. An image-forming material comprising:

a pyrylium-based squarylium compound represented by the following Formula (I); and a thermoplastic resin, Formula (I)

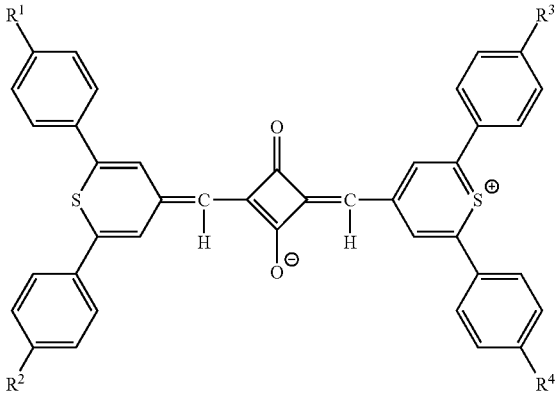

wherein in Formula (I), each of $R^1$, $R^2$, $R^3$, and $R^4$ independently represents an alkyl group having from 2 to 5 carbon atoms.

3. The image-forming material according to claim 2, wherein a glass transition temperature of the thermoplastic resin is from 50° C. to 150° C.

4. The image-forming material according to claim 2, further comprising a pigment.

5. The image-forming material according to claim 2, wherein an amount of the pyrylium-based squarylium compound ranges from 0.05% by weight to 10.0% by weight based on 100 parts of the image-forming material.

6. The image-forming material according to claim 2, which is a light-fixable toner.

7. The image-forming material according to claim 2, wherein the thermoplastic resin is a resin selected from a polyester resin, a styrene-acryl resin, a polyamide resin, a polyvinyl resin, a poly(alkyl methacrylate) resin, and an acrylic resin.

8. An image-forming method comprising:

forming an image on a recording medium by using the image-forming material according to claim 2; and fixing the image-forming material to the recording medium by irradiating the formed image with light having a wavelength of from 760 nm to 970 nm.

9. The image-forming method according to claim 8, wherein the light having a wavelength of from 760 nm to 970 nm is irradiated from a semiconductor laser.

10. The image-forming method according to claim 8, wherein an amount of the pyrylium-based squarylium compound ranges from 0.05% by weight to 10.0% by weight based on 100 parts of the image-forming material.

11. The image-forming method according to claim 8, wherein the thermoplastic resin is a resin selected from a polyester resin, a styrene-acryl resin, a polyamide resin, a polyvinyl resin, a poly(alkyl methacrylate) resin, and an acrylic resin.

* * * * *